United States Patent [19]

Wick

[11] 4,066,252

[45] Jan. 3, 1978

[54] COPYING APPARATUS

[75] Inventor: Richard Wick, Munich, Germany

[73] Assignee: AGFA-Gevaert, AG, Leverkusen, Germany

[21] Appl. No.: 685,161

[22] Filed: May 11, 1976

[30] Foreign Application Priority Data

May 16, 1975 Germany ..... 2521932

[51] Int. Cl.[2] ..... B65H 5/22

[52] U.S. Cl. ..... 271/3; 271/65; 271/186; 271/DIG. 9

[58] Field of Search ..... 271/3, 65, 186, DIG. 9

[56] References Cited

U.S. PATENT DOCUMENTS

| | | | |
|---|---|---|---|
| 3,227,444 | 1/1966 | Egan | 355/23 X |
| 3,615,129 | 10/1971 | Drawe | 271/65 X |
| 3,862,802 | 1/1975 | Till | 355/23 |

*Primary Examiner*—Richard A. Schacher
*Attorney, Agent, or Firm*—Michael J. Striker

[57] ABSTRACT

Two endless paths are provided, one for an original sheet and one for a copy sheet. The paths have respective parallel portions which extend past a copy station at which an image from an original sheet in the one path is reproduced onto a copy sheet in the other path. At will, one or both sides of the original sheet can be copied and one or both sides of the copy sheet can receive copy. To expose both sides of the respective sheet to the copy station, the sheet passes once through its path to the outlet thereof and is then moved in reverse, from the outlet to a set of switching points which reintroduce it into the path while turning it side-for-side in preparation for another pass past the copying station.

6 Claims, 7 Drawing Figures

COPYING APPARATUS

BACKGROUND OF THE INVENTION

The present invention relates to a copying apparatus in general, and more particularly to a copying apparatus which is especially suited for selectively copying one or both sides of an original onto one or both sides of a copy sheet or carrier.

Copying apparatus has been proposed in the prior art in which individual copy sheets are transported out of a receptacle and advanced to a copy station where a copy is made onto one side of the copy sheet which thereupon is advanced to an outlet receptacle and stacked therein in reversed or turned relationship. The receptacles are each in form of detachable cassettes or the like. If it is desired to provide a copy on the opposite (heretofore blank) side of the copy carrier or sheets in the outlet receptacle, then the outlet receptacle is removed and is placed into the machine in place of the inlet receptacle so that copy sheets are now withdrawn from the previous outlet (now inlet) receptacle and again fed to the copying station. Thus, as these copy sheets pass through the machine for a second time, their previously blank side is also provided with a copy.

This prior-art proposal has the disadvantage that the original to be copied must be turned over manually, and also that the cassettes which constitute the inlet and outlet receptacles must be manually detached and exchanged, one for the other. A fully automatic operation, requiring no manual intervention irrespective of whether one or both sides of the original are to be copied onto one or both sides of a copy carrier or sheet, is impossible with the prior-art proposal.

SUMMARY OF THE INVENTION

Accordingly, it is an object of the present invention to provide an improved copying apparatus which avoids the disadvantages of the prior art.

More particularly, it is an object of the present invention to provide such an improved copying apparatus which makes it possible to selectively — i.e. at the will of a user — copy either one or both sides of an original onto one or both sides of a copy sheet or carrier.

Another object of the invention is to provide such a copying apparatus which makes it possible to copy one or both sides of an original onto one or both sides of a copy sheet not only selectively, but fully automatically without requiring any manual intervention.

In addition object of the invention is to provide such a copying apparatus which is quite simple in its construction and hence extremely reliable and sturdy.

In keeping with the above objects and with others which will become apparent hereinafter, one feature of the invention resides in a copier, particularly for selectively copying one or both sides of a sheet-shaped original onto one or both sides of a copy sheet. Briefly stated, this copier comprises first means forming a first endless path for travel of the original and having a first inlet and a first outlet. Second means forms a second endless path for travel of the copy sheet and also having a second inlet and a second outlet. Third means is located at a copy station intermediate the respective inlets and outlets and is operative for reproducing an image from one of said sides of said original onto one of said sides of said copy sheet. Fourth means is provided for selectively turning the respective sheets side-for-side (the word side referring to the respective major surfaces) for renewed travel in their paths past the copy station.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS:

FIGS. 1–7 show a single exemplary embodiment of the invention in various views.

Figure 1:
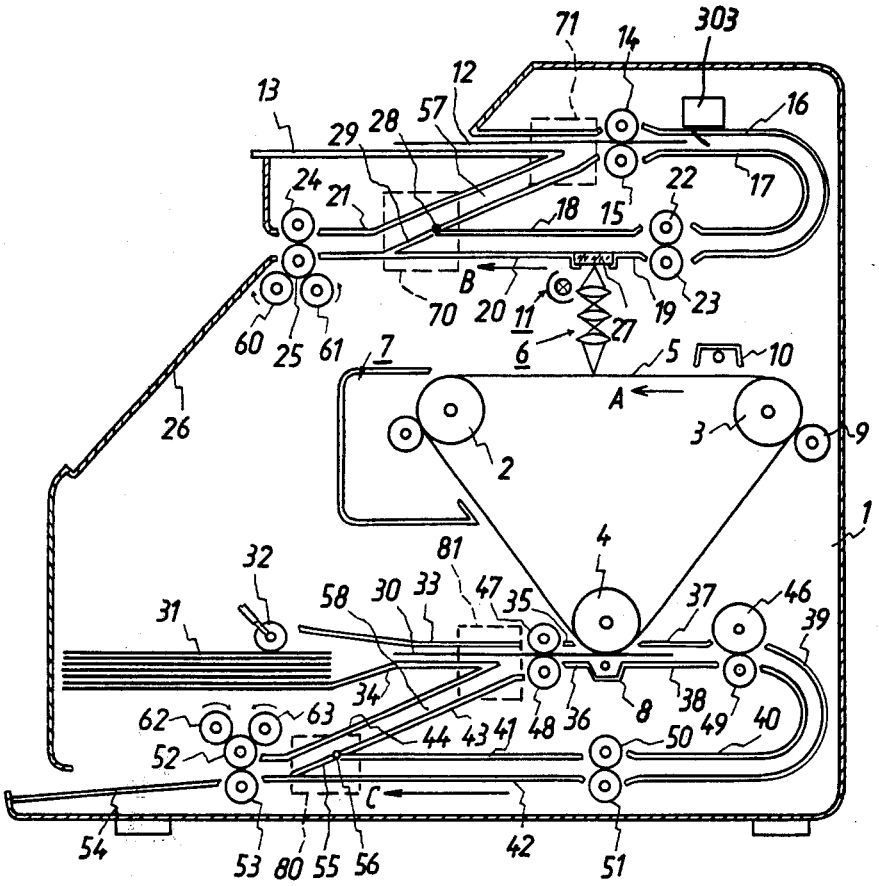
FIG. 1 is a somewhat diagrammatic vertical section through a copier embodying the invention.

Discussing first FIG. 1 it will be seen that reference numeral 1 identifies a housing in which a plurality of reversing rollers 2, 3 and 4 are journalled for rotation. These reversing rollers are driven by means of a not-illustrated motor and serve to advance a photoconductive belt or tape 5 which travels in the direction of the arrow A. Along the path traversed by the band 5 are provided a plurality of operating stations which are conventionally used in electrophotographic copying apparatus, for example the illuminating station with the light source 11, the imaging station 6, the toner station 7, the transfer corona 8, the cleaning station 9 and the charging corona 10. These stations, their construction and their operation are already well known in this field of art and therefore require no detailed discussion, especially inasmuch as they do not form a part of the central inventive concept.

Reference numeral 12 identifies a sheet-shaped original which is to be copied. For this purpose the original 12 is placed onto the support 13 and is pushed manually into the machine in direction towards the transport rollers 14, 15 until it is gripped by them. The original 12 is now drawn through the nip between the transports rollers 14, 15 and advanced between guide baffles 16–21 through the nip between a further pair of transport rollers 22, 23 and past the copying or imaging station until it reaches the pair of discharge rollers 24, 25. It is ejected from the nip between these rollers and enters a collecting tray 26. To permit a strip-wise scanning of the original 12, a transparent plate 27 of glass or the like is provided intermediate the guide baffle 19 and the guide baffle 20, bridging the gap between the same.

A plate 29 is provided which is pivoted along one of its edges so that it can swivel about a pivot axis 28 which in FIG. 1 extends normal to the plane of the drawing. The other edge of the plate 29 rests on the guide baffle 20 under the influence of gravity, i.e. due to the weight of the plate 29 itself. This weight is, however, not heavy enough to prevent an original 12 travelling in the direction of the arrow B to pass beneath the plate 29, or rather between the guide baffle 20 and that edge of the plate 29 which loosely rests upon the baffle.

The arrangement for transporting a copy sheet or carrier 30 in the machine is analogous to that described above with reference to the transport of the originals 12. Individual copy sheets 30 are withdrawn from a stack 31 by means of a feed roller 32 and are fed into a path which is defined by guide baffles 33–44 so that they travel in this path synchronously with the travel of the original 12 in its own path. When a copy sheet 30 reaches the photoconductive tape 5, which constitutes the intermediate or transfer image carrier and on which the electrostatically charged image is formed upon the application of toner powder at the station 7, the transfer corona 8 transfers this image onto the copy sheet 30. A heated pressure roller 46 which is also known in the art from this type of copying machine and which is coated on its outer circumference with polytetrafluoroethylene, serves to fix the image on the copy sheet 30.

The copy sheet 30 is transported along its path, i.e. in the direction of the arrow C, by pairs of rollers 47, 48, 46 and 49, 50 and 51 as well as the discharge roller pair 52 and 53 discharges the completed copy into the copy tray 54. A plate 55 corresponds to the plate 29 and is pivoted along its upper edge for pivoting movement about an axis 56. The lower edge of the plate 55 rests under the weight of the plate 55 on the guide baffle 42 and the copy carrier 30 can travel beneath it in the direction of the arrow C.

When the apparatus functions in the manner thus far described, i.e. when the original 12 and a copy sheet 30 travel in the described manner, the result is the production of a single copy which is imaged only on one of its sides, i.e. only on one of its major surfaces. The original 12 is ejected at the end of the single copy cycle into the tray 26 in which it comes to rest in a side-for-side reverse relationship, i.e. the major surface which at the beginning of the copy cycle was facing upwardly is now facing downwardly and vice versa. The same is true for the copy sheet 30 that has traversed the path defined by the guide baffles 33–44.

However, the operation is different if both sides of the original 12 are to be scanned and/or both sides of a copy sheet 30 are to be provided with an image. Instead of being ejected into the tray 26 by the rollers 24, 25 the orginal 12 enters the nip between these rollers but is retained therein. The same is true for the copy sheet 30 which has had an image reproduced on one of its sides and is engaged in and retained in the nips between the rollers 52 and 53. Once the original 12 and the copy sheet 30 are so retained, the direction of rotation of the pair of rollers 24, 25 and the pair of rollers 52 and 53 is reversed. The instrumentalities for effecting such reversal will be described later. At the moment it will suffice to point out that when such direction reversal occurs the original 12 and the copy sheet 30 which is imaged on one side, now travel counter to their original travel direction B and C, respectively. However, such travel in the original path is hindered by the presence of the plates 29 and 55, respectively. The result is that the original 12 is now propelled up over the plate 29 which constitutes a switching junction 70 and travels in a guide path 57 to an upper switching junction 71 where it becomes reinjected into the starting end of the travel path, to be gripped in the nip between the rollers 14, 15 and advanced towards the copy station. However, the original 12 has in this process been turned over, that is its two major surfaces have been reversed so that the previously upper one is now the lower one and vice versa. The same is true of the copy sheet 30 which moves up over the plate 55 constituting the switching junction 80 and travels in the path 58 to the upper switching junction 81 where it is injected into the nip between the rollers 47, 48. It, also, has been reversed in the sense that its previously upper major surface is now the lower one and vice versa.

To selectively either discharge an original 12 or a copy sheet 30 into the trays 26 and 54, respectively, after imaging of a single side, or to reverse their direction of movement so that the opposite side can also be imaged, requires no switchable junctions or other devices. Reference has previously been made to "switching junctions" which term should be understood to refer to junctions where the respective sheets are switched into or out of different paths of movement. This is distinct from a "switchable" junction which would — in contradistinction to the present invention — require movable components to effect the switching. The control of the desired mode of operation is effected exclusively by the direction-reversible pairs of discharge rollers 24, 25 and 52, 53. For this purpose these are in contact with respective drive wheels 60, 61 and 62, 63 which can be made to rotate in mutually opposite directions via magnetic clutches that will be described subsequently.

Details of the control mechanism of the apparatus in FIG. 1 will be described principally with reference to FIGS. 2–7.

It will be seen from FIG. 1 that the original 12 is pushed into the machine until it is engaged in the nip between the rollers 14, 15. These must of course be switched on for which purpose a switch is operated to start the drive for these rollers 14, 15. The original 12 and a respective copy sheet 30 are moved in their respective paths in synchronism with one another. It is evident, of course, that the time at which an original 12 is fed into the machine is independent of the time at which the drive for the transport rollers 14, 15 is switched on. Therefore, a feeler 303 is present which detects the incoming original 12 and which triggers the operation of a device for effecting transportation of a copy sheet 30 in synchronism with the transportation of the original 12.

This feeler 303 is illustrated diagrammatically in FIG. 1 as the contact of a microswitch. The contact is engaged by the original 12 as the latter passes in its path and is closed. This triggers the operation of a central control unit 150 shown in FIG. 3 which essentially comprises a timer that produces pulses which are in exact timed relationship to the transportation of the original 12 and the copy sheet 30.

Figure 2:
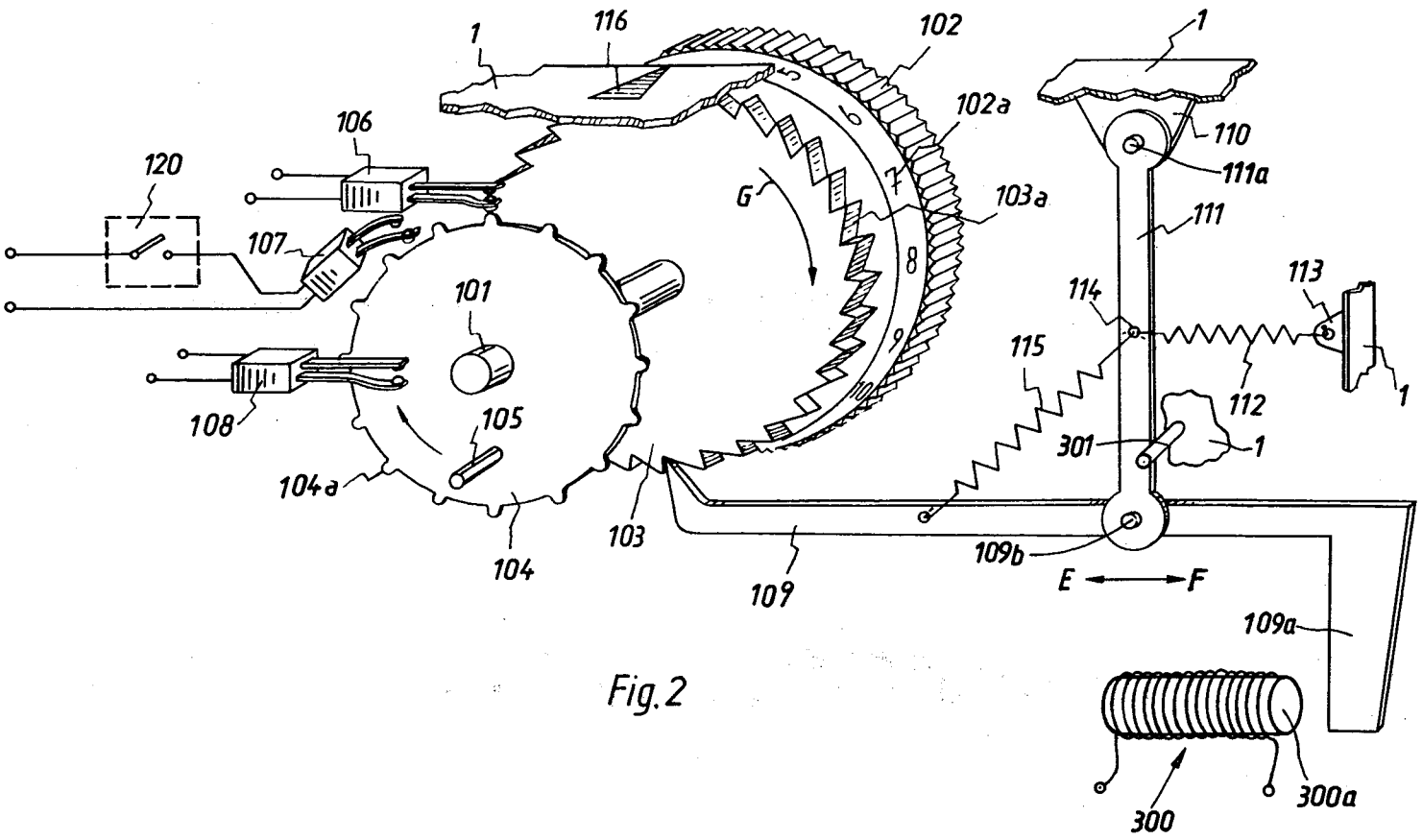
FIG. 2 is a perspective view showing details of a control arrangement of the apparatus in FIG. 1.

Before proceeding with a description of the operation of the unit 150, it is necessary to describe first the arrangement shown in FIG. 2. This is the control arrangement which controls the movement of the original 12 and the copy sheet 30. It has a shaft 101 on which there are mounted a selector wheel 102, a zero-setting wheel 103 and a further wheel 104 which carries a projecting pin 105 that operates a microswitch 108 as well as cam projections 104*a* which operate microswitches 106 and 107. The number of cam projections 104*a* is half the number of teeth 103*a* of the zero-setting wheel 103.

The wheel 103 is driven by a zero-setting pawl 109 which in turn is actuated by mechanism to be described with reference to the other Figures. Pawl 109 is pivoted at 109*b* to an arm 111 which is in turn pivoted at 111*a* to a portion 110 of the machine housing or frame 1. Thus, pawl 109 is reciprocable in the direction of the double-headed arrow E-F. A spring 112 has its opposite ends connected to a part 113 of the machine frame 1 and to a projection or eyelet 114 of the arm 111. A further spring 115 is connected between the arm 111 and the pawl 109 and urges the tip thereof into engagement with the wheel 103.

The wheel 102 is provided with a plurality of indicia 102*a*, each of which is indicative of the number of copies to be produced. A desired number of copies is set by placing the requisite indicium 102*a* opposite a selector mark 116 on the housing or frame 1 of the machine. Now, the starting switch of the machine is operated. At the beginning of each copy cycle the wheel 103 is now advanced automatically to the extent of one tooth, i.e. it is advanced in the direction indicated by the arrow G until the next-lower indicium 102*a* is located opposite the marker 116. After the selected number of copies has been made, the indication zero (not shown) will be located opposite the marker 116. This is so because the rotation of the wheel 103 is transmitted to the selector wheel 102 via the common shaft 101 on which they are mounted and is also transmitted to the wheel 104. The original 12 continues to travel in its endless path — in which it is shunted back to the beginning of the path via the portion 57 at the end of each copy cycle, until the pin 105 moves into engagement with the contact of the microswitch 108, thereby initiating the signal for discharging of the original 12 into the tray 26 and for the subsequent shut-down of the apparatus.

For each traversal of its paths by the original 12, a different copy sheet travels in synchronism through its own path. Of course, if both sides of the copy sheet are to be imaged, then the copy sheet will be shunted back at the end of the first copy cycle to traverse its path in turned relationship so as to be imaged on its other side. In such a case, the microswitch 106 will be closed after each two successive switching steps, i.e. after the wheel 103 has been advanced in the direction of the arrow G by two of its teeth 103*a*, and this closing of the microswitch 106 is effected by the engagement of its contact with the respective cam projections 104*a*. Thus, after both sides of the copy sheet 30 have been imaged, it is ejected from its path into the tray 54. When the microswitch 106 is open, this serves as the signal for the injection of a new blank copy sheet 30 from the stacks 31 into the travel path.

An additional microswitch 107 will be seen in FIG. 2 to be so arranged that it will be opened when the microswitch 106 is closed, and vice versa. When the switch 107 is closed it triggers a discharge of a copy sheet 30, just as does the microswitch 106 in closed condition; however, in the case of the closed microswitch 107 this discharge takes place only if at the same time a switch 120 is also closed. This switch 120 is operated from outside of the apparatus and constitutes the mode-selecting switch for permitting selectively copying onto one or both sides of a copy sheet 30. When the switch 120 is in open condition this indicates that both sides of the copy sheet 30 are to receive an image, and when it is closed it indicates that only a single side of the copy sheet 30 is to receive an image. Evidently, this relationship can be reversed.

It is clear that when the "single side" copying mode has been chosen, the respective copy sheet 30 is discharged into the tray 54 at the end of each single copy cycle. During the next-following cycle the original 12 simply traverses its path once more so that it will again be turned side-for-side in order to be back in the proper position for the making of the next image on a new copy sheet 30.

Figure 3:
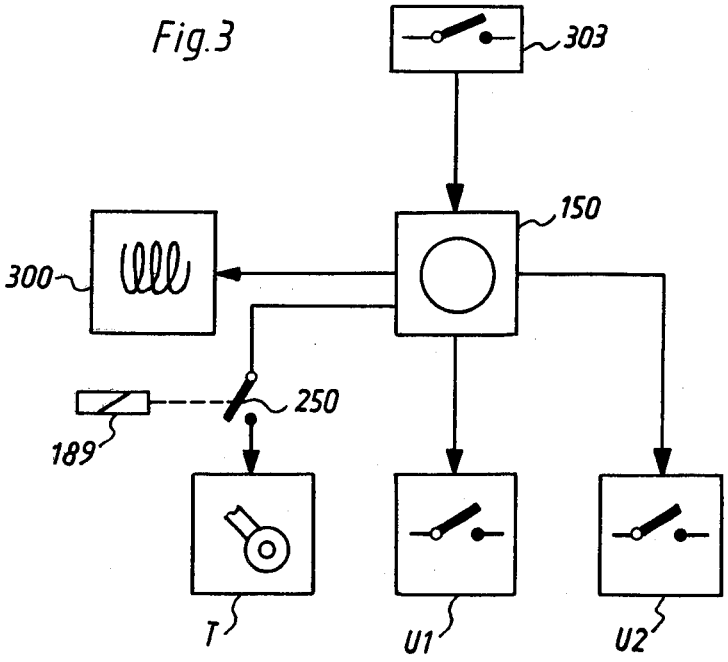
FIG. 3 is a circuit diagram illustrating a portion of the control circuit of the apparatus in FIG. 1.

As has been previously indicated, closing of the microswitch triggers operation of the central control unit 150 shown in FIG. 3 and this immediately leads to activation of a unit 300 which operates the movement of the pawl 109. Also triggered for operation is the unit T which starts up operation of the feed roller 32 and the units U1 and U2 (to be described subsequently) which control the direction-reversal of the rollers 24–25 and 52–53, respectively.

Figure 4:
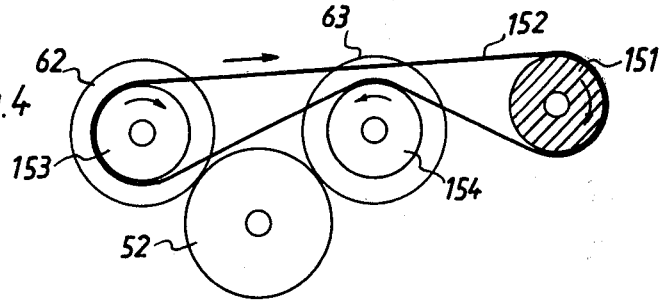
FIG. 4 is an end elevation, partly in section, showing details of a drive mechanism for a transporting roller in the apparatus of FIG. 1, the section of FIG. 4 being taken on line IV—IV of FIG. 5.
Figure 5:
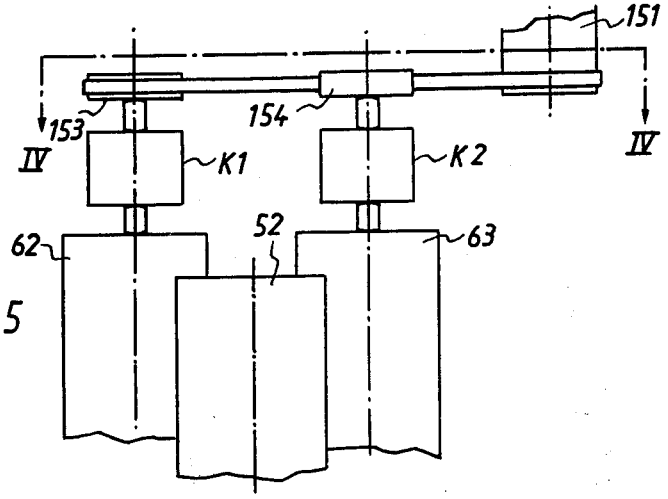
FIG. 5 is a top-plan view of FIG. 4.

FIGS. 4 and 5 illustrate the drive mechanism for the roller 52; as the mechanism for the roller 25 is identical thereto, only one such mechanism need to described and illustrated.

As FIGS. 4 and 5 show, a drive shaft 151 is provided which drives a timing belt 152 which in turn drives wheels 153 and 154 in such a manner that they rotate in mutually opposite directions (compare the arrows). These drive wheels 153, 154 are coupled with rollers 62, 63 via respective magnetic couplings K1 and K2. Only one of the magnetic couplings K1 and K2 is activated at any one time, so that only one of the rollers 62 or 63 is driven at only one time. The respectively driven roller in turn frictionally drives the roller 52 in one or the other direction of rotation.

Figure 6:
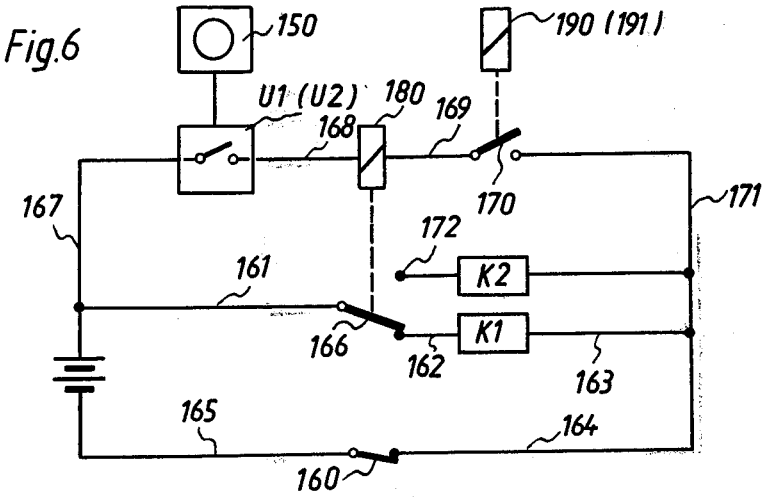
FIG. 6 is a diagram showing the control arrangement for magnetic couplings shown in FIG. 5.

The control device for control of the magnetic couplings K1 and K2 is shown in FIG. 6. When the main switch of the apparatus (not shown) is operated to start up the apparatus, the switch 160 of the device in FIG. 6 is closed so that current flows via conductors 161–165 and via a switch 166 to energize the magnetic coupling K1 whereby the roller 52 is driven in such a sense that the copy sheet (and analogously the original 12 since the same drive is provided for the roller 25) is ejected into the tray (54 or 12, respectively).

If, however, both sides are to be copied then the copy sheet 30 (and analogously the original 12) is not to be ejected from between the rollers 52, 53. Instead, the direction of rotation of the roller and hence the direction of movement of the copy sheet 30 is to be reversed. For this purpose the direction of rotation of the roller 52 (and analogously of the roller 25) is automatically briefly reversed at the moment at which the copy sheet is in the region of the switching junction 80, i.e. is engaged in the nip between the rollers 52 and 53. The timing of the direction reversal is controlled by the unit 150 which at the appropriate moment issues a pulse that operates the reversing switches U1 or U2. For the duration of this pulse the switches U1, U2 are closed, so that current flows via conductors 167, 168, 169, the normally closed switch 170 and conductors 171, 164 and 165. This causes the relay 180 to become energized and to operate the switch 166 so that it is engaged with the contact 172 of the magnetic coupling K2, thereby disengaging the coupling K1 and energizing the coupling K2. The direction of rotation of the roller 52 is thereby reversed and the copy sheet 30 is made to return to the beginning of its path via the guide path 58. Analogously, this arrangement operates in the same way for the original 12.

At the end of each copy cycle the copy sheet 30 is to be ejected into the tray 54 after it has received an image on one side, or in the case of double-sided imaging after it has past twice through its path and both sides of received an image. To assure such ejection, additional instrumentalities are provided to defeat when necessary the arrangement for effecting the reversal of the rotation of the roller 52 (and analogously of the roller 25). Therefore, a further switch 170 is interposed in the circuit of the relay 180; this switch 170 can be opened via a relay 190 or 191 so that the circuit or relay 180 is interrupted and the switch 166 cannot be operated, thereby assuring that the roller 52 can be rotated only in one direction, namely in a sense ejecting the copy sheet 30 into the tray 54.

Figure 7:
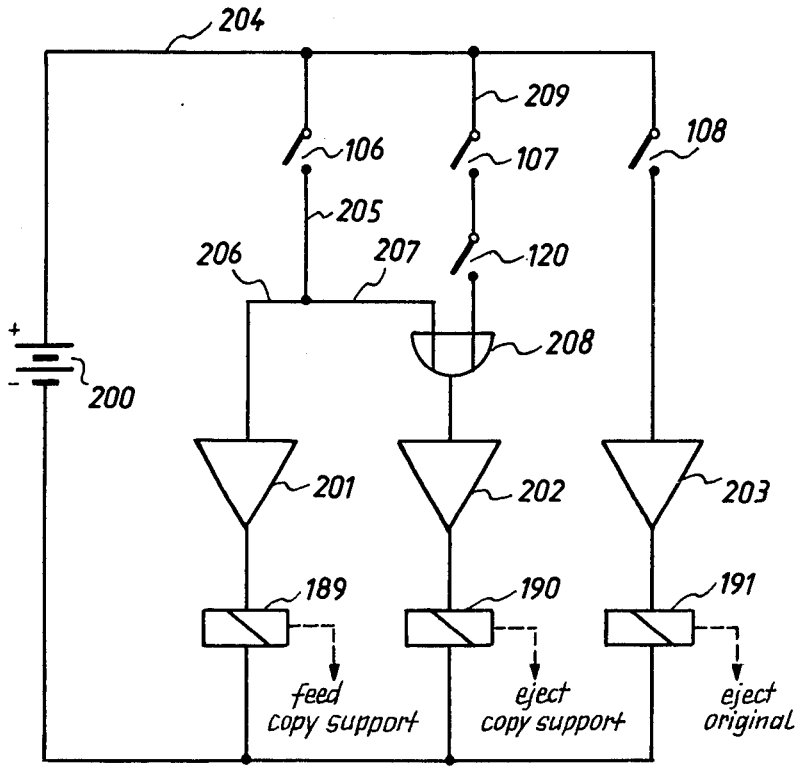
FIG. 7 is a circuit diagram showing a portion of the control circuit of the apparatus in FIG. 1.

The arrangement which controls the relays 190, 191 is shown in FIG. 7 which should be considered in conjunction with FIG. 2 and the switches 106, 107, 108 and 120 shown therein.

It is seen in FIG. 2 that a circuit is provided which is powered by a source of electrical energy 200. In this circuit there are interposed three relays 189, 190 and 199 with associated amplifiers 201, 202 and 203, the devices being connected in series. In the conductor 205 which connects the conductor 204 that lies at the positive pole of the source 200, via the conductor 206 with the input of the amplifier 201 and additionally via the conductor 207 with one input of an OR-gate 208, there is arranged the microswitch 106 described earlier with respect to FIG. 2. The microswitch 107 and the switch 120 are arranged in the conductor 209 which connects the conductor 204 with the other input of the OR-gate 208. The output of the OR-gate 208 is connected to the input of the amplifier 203 and the microswitch 108 is connected into the circuit of the amplifier 203.

If the operating mode "copying on one side" has been selected, the switch 120 is closed and during each copying cycle either the switch 107 or the switch 106 is closed. Thus, during each copying cycle a positive signal is supplied via the OR-gate 208 to the amplifier 202. Every time this happens the relay 190 is operated so that the switch 170 is constantly open, and the direction-reversal arrangement for the roller 52 is ineffective, thereby assuring that after a single traverse of its path the copy sheet 30 is ejected by the rollers 52, 53 into the tray 54.

The switch 108 is normally open so that the relay 191 cannot become energized. Thus, after each copying cycle the original 12 is shunted back to the beginning of its path via the guide path 57 until the desired number of copies has been made at which time the pin 105 of FIG. 2 engages and closes the switch 108, so that the relay 191 opens the switch 170 and permits the original 12 to be ejected by the rollers 24 and 25 into the tray 26.

During every second copying cycle the microswitch 106 is closed so that the relay 189 becomes energized, opening the normally closed switch 250 (FIG. 3) which is interposed between the device 150 and the copy sheet feeding arrangement T that is controlled by the same, so that the switch 250 in its open position prevents a feeding of copy sheets 30 into the copying path.

If the operating mode "copying on both sides" is selected, then the switch 120 is open so that each copy carrier 30 is ejected only at the end of two copying cycles, when the switch 106 is closed. The other functions such as the supply of copy sheets and the ejection of the original, are controlled in the same manner as discussed above with the operating mode "copying on one side".

The reciprocation of the pawl 109 in FIG. 2 in the direction of the double-headed arrow E-F can be effected by means of an electromagnet 300 which is energized at the time of operation of the microswitch 303, i.e. at the beginning of each copying cycle, via the control device 150 so as to act upon the right-hand end portion **109*a* of the pawl 109. The movement of the pawl 109 is limited by its engagement with the endface 300*a* of the stationary magnet 300 and by the abutment pin 301 which is also stationarily mounted on the housing or frame 1** of the apparatus.

It is advantageous if the transport path for the original and the copy carrier is U-shaped intermediate the point of entry and the point of exit (inlet and outlet) of the carrier and copy sheet, respectively, into the respective path. It is also advantageous if the direction-reversible devices, i.e. in the exemplary embodiment the rollers 24–25 and 52–53, respectively, are located at or adjacent the sheet outlet and that the respective switching junctions are located at the inlet and outlet ends of the arms of the U-shaped path.

A particular advantage of the arrangement described herein is the fact that the location at which the original 12 is fed into the machine, the tray 26 for the copied original and the tray 54 for the copies, are all located at one and the same side of the apparatus so that the convenience of operation is greatly increased.

It will be understood that each of the elements described above, or two or more together, may also find a useful application in other types of constructions differing from the types described above.

While the invention has been illustrated and described as embodied in a copying apparatus, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A copier, particularly for selectively copying one or both sides of a sheet-shaped original onto one or both sides of a copy sheet, comprising first means defining a first endless path for travel of said original and having a first inlet and a first outlet through which the original issues; second means defining a second endless path for travel of said copy sheet and having a second inlet and a second outlet through which the copy sheet issues; third means located at a copy station intermediate the respective inlets and outlets and operative for reproducing an image from either of said sides of said original onto either of said sides of said copy sheet; and fourth means for transporting said original and said copy sheet, respectively, in their associated paths, and for selectively turning the respective sheets side-for-side for renewed travel in their paths past said copy station, said fourth means including transporting elements mounted outwardly adjacent the respective outlets of said paths, and means for selectively reversing the transporting direction of said transporting elements when the respective sheets are to be reversed so as to return such sheets into the respective endless path.

2. A copier as defined in claim 1, each of said endless paths having a turning loop for the original and copy sheet, respectively; and wherein said fourth means comprises for each path two cooperating switching junctions for selectively discharging or reinstituting and turning said original and said copy sheet, respectively.

3. A copier as defined in claim 1, wherein each of said paths has a U-shaped section intermediate the associated inlet and outlet and which includes an entry side and an exit side; one of said switching junctions of the respective path being provided at said exit side for reversing the original or copy sheet, and the other of said switching junctions of the same path being located at said entry side and receiving the turned original or copy sheet and reinserting it into the path.

4. A copier as defined in claim 1; and further comprising means for selectively operating said reversing means in dependence upon whether or not the respective sheet is to be turned side-for-side.

5. A copier as defined in claim 1, wherein said fourth means comprises in each of said paths, inwardly adjacent the respective outlet, a gravity switch which is normally in a position in which it extends across the path and yields temporarily to the passage of a sheet traveling towards the associated outlet but returns to said position under the influence of gravity when the sheet is past.

6. A copier, particularly for selectively copying one or both sides of a sheet-shaped original onto one or both sides of a copy sheet, comprising first means defining a first endless path for travel of said original and having a first upstream branch provided with a first inlet, a first downstream branch provided with a first outlet through which the original issues, and a first shunting branch connecting said first upstream and downstream branches inwardly of said first inlet and outlet, respectively; second means defining a second endless path for travel of said copy sheet and having a second upstream branch provided with a second inlet, a second downstream branch provided with a second outlet through which said copy sheet issues, and a second shunting branch connecting said second upstream and downstream branches inwardly of said second inlet and outlet, respectively; third means located at a copy station intermediate the respective inlets and outlets and operative for reproducing an image from either of said sides of said original onto either of said sides of said copy sheet; and fourth means for returning the respective sheets with the respective endless path, thereby selectively shunting the respective sheets into the associated shunting branches and turning them side-for-side for renewed travel in their paths past said copy station.

* * * * *